US005222740A

United States Patent [19]

Wu et al.

[11] Patent Number: 5,222,740

[45] Date of Patent: Jun. 29, 1993

[54] ENTERTAINING TARGET

[76] Inventors: Jenn-Jia Wu, 12-1 Lane 167, Hua Hsin St., Chung Ho City, Taipei; Jinn-Shing Liaw, 13, Alley 5, Lane 85, Paochiao Rd., Hsintien City, Taipei, both of Taiwan

[21] Appl. No.: 848,935

[22] Filed: Mar. 10, 1992

[51] Int. Cl.[5] ..... F41J 5/04

[52] U.S. Cl. ..... 273/371; 273/382; 273/354; 273/389; 273/402

[58] Field of Search ..... 273/371, 381, 382, 383, 273/389, 398, 401, 402, 403, 446, 354

[56] References Cited

U.S. PATENT DOCUMENTS 3,054,614 9/1962 Dean ..... 273/446

*Primary Examiner*—Benjamin H. Layno

*Attorney, Agent, or Firm*—Morton J. Rosenberg; David I. Klein

[57] ABSTRACT

An entertaining target comprises a box, a sound and light control device attached inside the box and a balloon. The front opening of the box is attached with an openable front lid formed with a target hole in the middle, and inside the box there is provided a touch-off switch connecting to the sound and light control device which is pressed by the balloon to disconnect the electricity to the control device. When a player takes his shot on the target, the bullet successfully hit into the target hole will pop the balloon and the front lid will be pushed to open by the explosion of the balloon to allow another balloon to be placed, meanwhile the touch-off switch is released by the explosion to start the sound and light control device to generate entertaining sound and light.

1 Claim, 3 Drawing Sheets

ENTERTAINING TARGET

BACKGROUND OF THE INVENTION

The present invention relates to a creative entertaining target for use in various shooting games which has a novel and distinguish structure with high entertaining and intelligent-stimulating effect.

All kinds of shooting games are getting more and more popular. Besides their exercise effect on physical aspect, they also provide high entertainment which is incomparable with other games. But it is known that shooting materials, such as guns, for these games are considerably dangerous; although they are not necessarily fatal, once the players use them carelessly without considering of getting actual security equipments, accidents are likely to occur easily.

Instead of players shooting each other, using a target for shooting can avoid such risk. However, conventional targets on the market are either curtly made without attractive outlook or complicatedly structured with high price.

It is therefore considered that a shooting target with simple structure, high entertainment, low price and fine durability would satisfy the need of shooting fanciers.

SUMMARY OF THE INVENTION

With regard to the foregoing consideration, the present invention provides an entertaining target with novel and distinctive structure for use with various shooting materials.

It is the first object of the present invention to provide an entertaining target for shooting games which has a box with a sound and light control device attached inside and a balloon. When the player with any shooting material succeeds to hit into the target hole on the box, the balloon placed inside will be popped and the sound and light control device will then be started by the explosion of the balloon to generate entertaining sound and light.

It is a further object of the present invention to provide an entertaining target, for use in target practice with all kinds of shooting materials, which is economical and practical with its simple structure, easy operation, low cost and fine durability.

DESCRIPTION OF THE PREFERRED EMBODIMENTS

Figure 1:
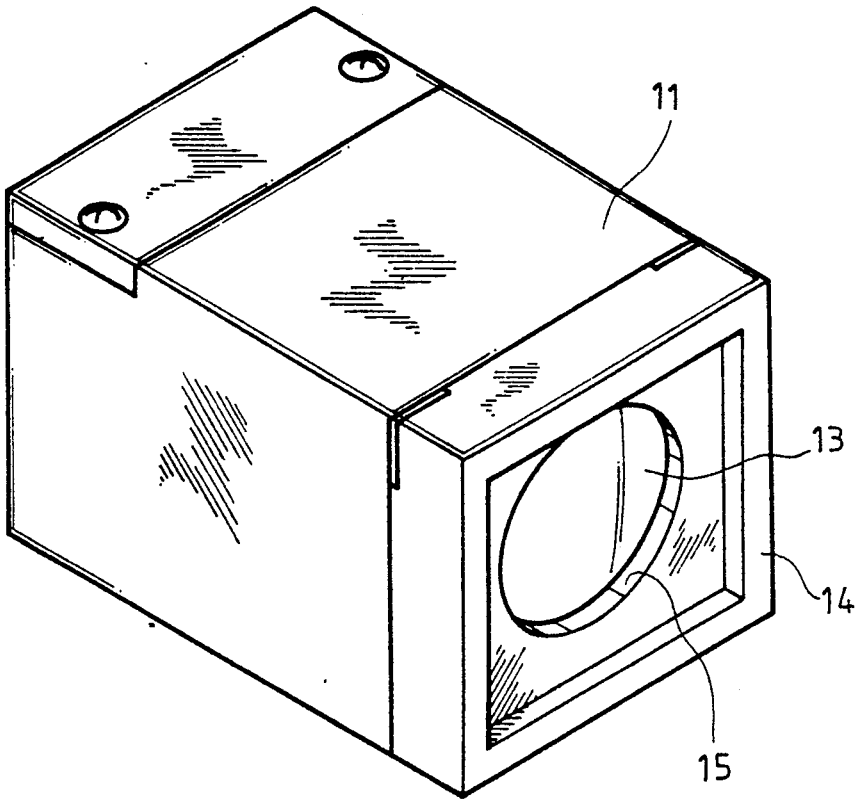
FIG. 1 is a perspective view of the present invention.

Referring to the drawings, it is seen that the present invention, entertaining target, comprises a box 11, a sound and light control device 12 attached in the box 11 and, a balloon 13.

At the front of the box 11, there is provided an openable front lid 14 which has a target hole 15 formed in the middle and two metal pieces 16, 17 affixed respectively on the two top corners of the front lid 14. On the bottom surface inside the box, there is equipped a touch-off switch 18 relating to the sound and light control device. When the balloon 13 with an appropriate size is placed in the box 11, the touch-off switch 18 will be pressed by the balloon to disconnect the electricity to the sound and light control device 12.

Figures 2, 2A:
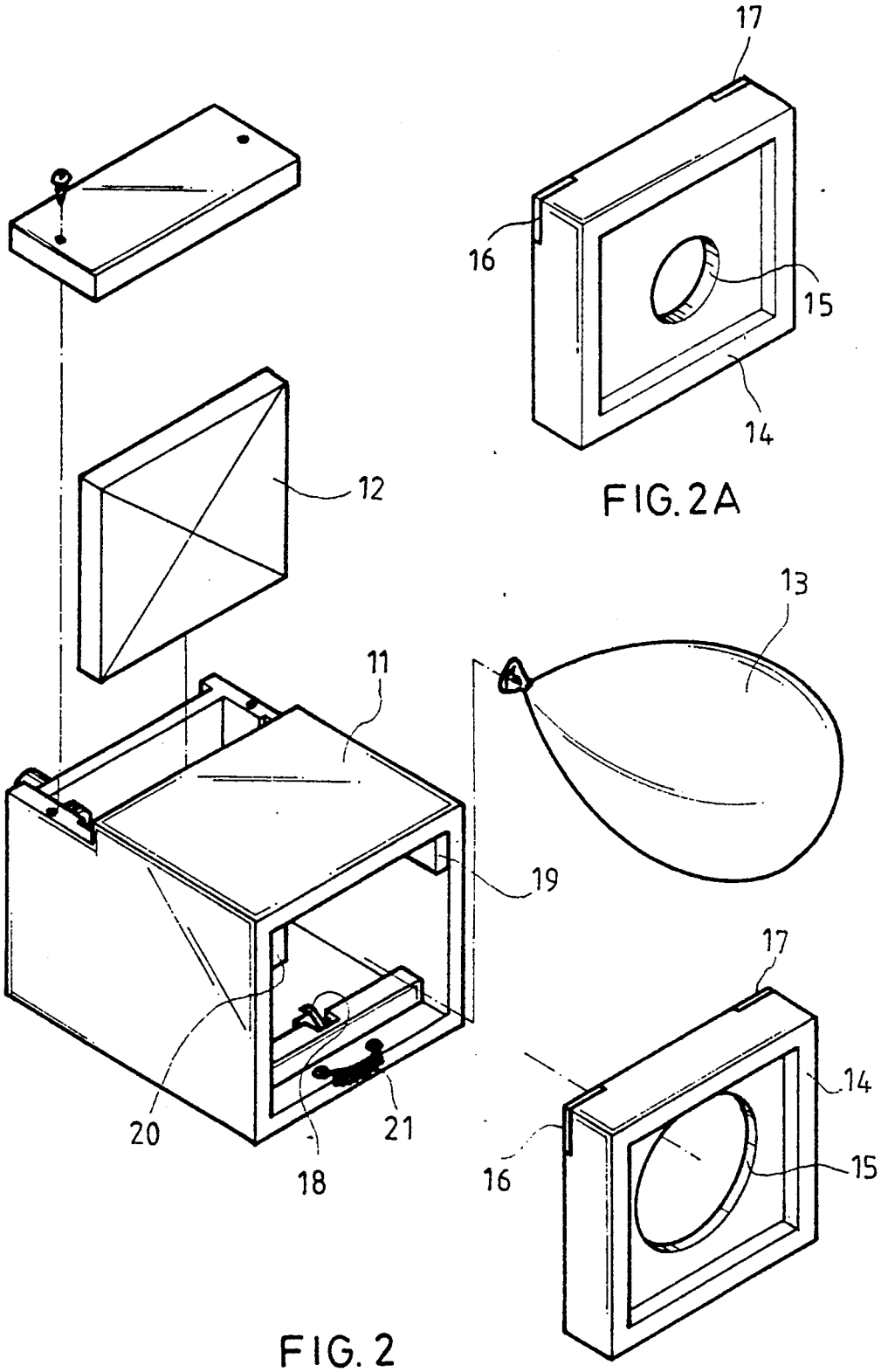
FIG. 2 is a disconstructed perspective view of the parts of the present invention.
Figure 3:
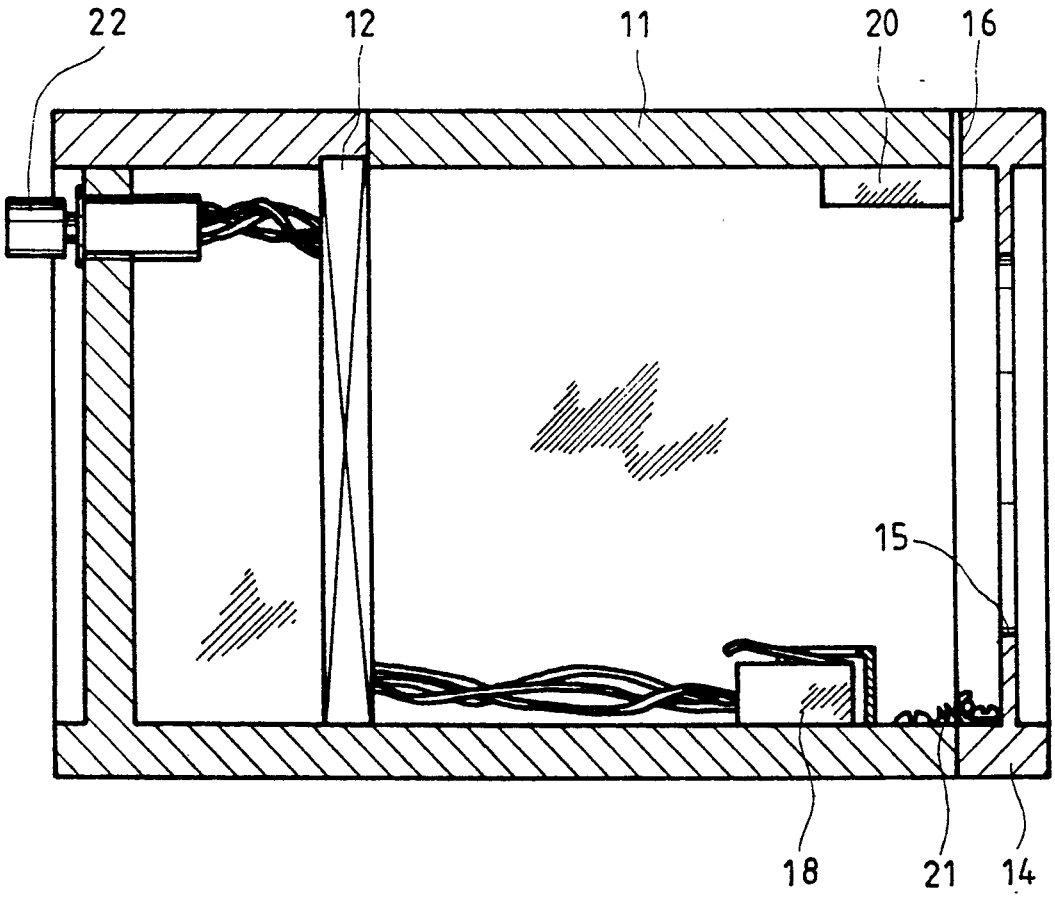
FIG. 3 is a side-sectional view of the present invention.

As shown in FIG. 2, the top two corners at the front opening of the box 11 are respectively affixed with magnets 19, 20, and on the bottom surface near the opening, there is provided an elastic band 21. The front lid 14 can be held tightly onto the opening of the box by the elastic band 21 holding the bottom edge of the lid 14, and by the magnets 19, 20 attaching the metal pieces 16, 17 on the top of the lid 14.

The sound and light control device 12 is installed at the rear part inside the box 11. A further button 22 connecting to the sound and light control device 12 is provided at the back side of the box 11 to be pressed and disconnects the electricity for the sound and light control device and thereby to dysfunction the device 12.

When the player with a shooting material takes his shot on the entertaining target, any bullet successfully hit into the target hole 15 can pop the balloon 13 and the front lid 14 is then pushed to open by the force of the explosion of the balloon; meanwhile, the touch-off switch 18 which is pressed by the balloon is then released to start the sound and light control device 12. Entertaining sound and light is therefore generated to announce the successful hit of the player. The opened front lid 14 allows another balloon to be placed into the box for the next target practice.

The target hole 15 in the middle of the front lid 14 can be made into various sizes as desired to vary the difficulty of shooting which would increase further fun for the target practice.

The present invention, entertaining target, as forementioned is preferable for all sort of players by its simple structure and easy operation. Furthermore, the novel design of the present invention which is distinctive and has never been introduced before can achieve high entertainment. Therefore it is believed that the present invention is actually a creative and practical new invention.

What is claimed is:

1. An entertainment target system comprising:

(a) a box housing defining an internal chamber for insert therein of a balloon, said balloon for compressively interfacing with a normal-off switch mounted within said box, said box housing having an open frontal section, said frontal section having a pair of magnets mounted thereon;

(b) a plurality of lid members anyone of which is releaseably secured to said box housing for covering said frontal section opening, each front lid member having an opening of a predetermined dimensional size formed therethrough, wherein the predetermined dimensional sizes of the openings of at least two of said plurality of front lid members being different from one another for selective purposes, each front lid member having a pair of magnetically attractive metal strip members secured thereto for alignment with said magnets mounted to said box housing, said front lid member being elastically coupled to a lower wall of said box housing by an elastic band coupling; and, (c) audio and visual indication means electrically coupled to said normal-off switch and mounted within said internal chamber of said box housing for visually and audially indicating removal of said balloon from compressive interface with said normal-off switch, said audio and visual indication means being coupled to an on-off switch member for electrically activating and deactivating said audio and visual indication means, whereby removal of said compressive interface of said balloon with said normal-off switch electrically activates said audio and visual indication means.

* * * * *